US008277248B2

(12) United States Patent
Blakborn

(10) Patent No.: US 8,277,248 B2
(45) Date of Patent: Oct. 2, 2012

(54) HIGH FREQUENCY PLUG CONNECTOR

(75) Inventor: Willem Blakborn, Inzell (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 13/128,922

(22) PCT Filed: Oct. 29, 2009

(86) PCT No.: PCT/EP2009/007756

§ 371 (c)(1),
(2), (4) Date: May 12, 2011

(87) PCT Pub. No.: WO2010/054750

PCT Pub. Date: May 20, 2010

(65) Prior Publication Data

US 2011/0217870 A1 Sep. 8, 2011

(30) Foreign Application Priority Data

Nov. 12, 2008 (DE) ..... 20 2008 015 000 U

(51) Int. Cl.
*H01R 12/00* (2006.01)

(52) U.S. Cl. ..... 439/581; 439/63

(58) Field of Classification Search ..... 439/578, 439/581, 63

See application file for complete search history.

(56) References Cited

U.S. PATENT DOCUMENTS 5,879,166 A 3/1999 Wang
6,386,888 B1 * 5/2002 Skopic et al. ..... 439/63
6,390,825 B1 * 5/2002 Handley et al. ..... 439/63
6,491,542 B1 * 12/2002 Zerebilov ..... 439/489
6,776,621 B1 * 8/2004 Dye ..... 439/63
6,824,403 B2 * 11/2004 Hall et al. ..... 439/108
7,029,286 B2 * 4/2006 Hall et al. ..... 439/63
7,048,581 B1 * 5/2006 Wong ..... 439/595
7,052,319 B1 * 5/2006 Chen ..... 439/595
7,101,189 B1 * 9/2006 Huss et al. ..... 439/63
7,267,570 B2 * 9/2007 Fry et al. ..... 439/357
7,285,011 B2 * 10/2007 Hardy et al. ..... 439/582
7,326,063 B1 * 2/2008 Raudenbush et al. ..... 439/63
7,335,065 B1 * 2/2008 Chen et al. ..... 439/654
7,347,742 B2 * 3/2008 Hall et al. ..... 439/752
7,491,087 B2 * 2/2009 Swantner et al. ..... 439/582

(Continued)

FOREIGN PATENT DOCUMENTS

EP 1150387 A1 10/2001

(Continued)

*Primary Examiner* — Ross Gushi

(74) *Attorney, Agent, or Firm* — DeLio & Peterson, LLC; Robert Curcio

(57) ABSTRACT

An HF plug connector having an outside conductor part, and inside conductor part arranged within the outside conductor part and an end on the mating side that is designed for a plug-in connection to a complementary HF plug connector, wherein a housing made of an electrically insulating material, is arranged on the mating side end of the HF plug connector, at least partially surrounding the outside conductor part, wherein the housing exhibits a through-hole into which the outside conductor part engages. The outside conductor part has a first axial retaining element designed to a first predetermined section of the housing upon assembly on the outside conductor part and a second axial retaining element designed so that said second axial retaining element presses a second predetermined section of the housing together upon assembly on the outside conductor part.

23 Claims, 6 Drawing Sheets

U.S. PATENT DOCUMENTS

| | | | | |
|---|---|---|---|---|
| 7,494,374 | B2 * | 2/2009 | Hall et al. | 439/564 |
| 7,563,103 | B1 * | 7/2009 | Hall et al. | 439/63 |
| 7,762,854 | B1 * | 7/2010 | Peng | 439/752 |
| 7,794,274 | B2 * | 9/2010 | Phillips, Jr. | 439/578 |
| 8,043,117 | B2 * | 10/2011 | Blakborn et al. | 439/578 |
| 2001/0053629 | A1 * | 12/2001 | Togashi et al. | 439/578 |
| 2003/0176104 | A1 | 9/2003 | Hall | |
| 2004/0157498 | A1 * | 8/2004 | Hall et al. | 439/680 |
| 2005/0159021 | A1 * | 7/2005 | Swantner et al. | 439/63 |
| 2007/0054535 | A1 * | 3/2007 | Hall et al. | 439/352 |
| 2007/0093120 | A1 * | 4/2007 | Hardy et al. | 439/468 |
| 2007/0281552 | A1 * | 12/2007 | Gleissner et al. | 439/680 |
| 2008/0233796 | A1 * | 9/2008 | Segrt | 439/578 |
| 2009/0130902 | A1 * | 5/2009 | Hall et al. | 439/595 |
| 2009/0220013 | A1 * | 9/2009 | Butts et al. | 375/257 |
| 2010/0029132 | A1 * | 2/2010 | Phillips, Jr. | 439/584 |
| 2010/0112844 | A1 * | 5/2010 | Manser | 439/350 |
| 2010/0261379 | A1 * | 10/2010 | Blakborn et al. | 439/578 |
| 2011/0008999 | A1 * | 1/2011 | Annequin et al. | 439/582 |
| 2011/0092095 | A1 * | 4/2011 | Annequin | 439/578 |
| 2011/0217870 | A1 * | 9/2011 | Blakborn | 439/578 |
| 2011/0217871 | A1 * | 9/2011 | Benham et al. | 439/583 |

FOREIGN PATENT DOCUMENTS

| | | | |
|---|---|---|---|
| EP | 1154522 | A2 | 11/2001 |
| EP | 1383206 | A1 | 1/2004 |

* cited by examiner

HIGH FREQUENCY PLUG CONNECTOR

BACKGROUND OF THE INVENTION

This application is a National Stage filing based on PCT/EP2009/007756, filed Oct. 29, 2009, and which claims priority to German Patent Application No. DE 20 2008 015 000.0, filed Nov. 12, 2008.

1. Field of the Invention

The present invention relates to a High Frequency (HF) plug connector having an outer conductor part, an inner conductor part arranged within the outer conductor part and a mating-side end which is configured for plug-in connection to a complementary HF plug connector, wherein a housing made from an electrically insulating material, particularly a plastics housing, is arranged at the mating-side end of the HF plug connector, at least partially surrounding the outer conductor part, wherein the housing has a through bore in which the outer conductor part engages.

2. Description of Related Art

US 2003/0176104 A1 discloses a coaxial plug connector having a plastics housing and complying with the FAKRA standardization scheme (FAKRA=Fachkreis Automobiltechnik (Automobile Expert Group)) for SMB connectors. A plastics housing is provided herein, which holds and protects the plug-in connector and positions the connector for plugging to another plug-in connector with a plastics housing. The housing also has mechanical codings so that only matching housings can be plugged into one another.

Plastics housings of this type for coaxial plug-in connectors, also known as FAKRA housings are used in the field of automotive technology for data transmission cables. These data transmission cables are usually coaxial cables or similar cables based on an electrical conductor. The mechanical dimensions of such FAKRA housings in the interface region, i.e., in an axial section of the housing which interacts with a complementary plug, in order to create a mechanical connection between the two plastics housings, are defined in DIN-Norm 72594-1 in the version dated October 2004. The part entitled "Road vehicles—50 Ohm high frequency interface (50-Ω-HFSSt-Part 1: Dimensions and electrical requirements" of the above DIN-Norm 72594-1 defines plugs and couplers of an interface with an impedance of 50 Ohms for high frequency applications (50-Ω-HFSSt) in road vehicles and thus ensures communication to and from the vehicle. It defines dimensional and electrical requirements and properties and ensures the interchangeability thereof. All the well known automobile manufacturers apply this standard in their production. The content of the standard is defined by the Normenauschuss Kraftfahrzeuge (FAKRA).

The Automobile Expert Group (FAKRA) within DIN represents the regional, national, and international standardization interests in the field of motor vehicles. The responsibilities of FAKRA cover the drawing up of all standards regarding compatibility, interchangeability and safety for road vehicles according to DIN 70010 (except agricultural tractors), regardless of whether these road vehicles are equipped with combustion engines, electric motors, or hybrid drives. FAKRA also draws up standards for the bodywork of these road vehicles (except for municipal vehicles, fire fighting vehicles, and ambulances). It is also responsible for standardization of the entire equipment of the aforementioned vehicles and bodywork and for standardization of freight containers (ISO containers). Standardization promotes rationalization and quality assurance in the field of vehicle manufacturing as well as the environmental compatibility of vehicles. The group also contributes, in accordance with the state of the art and current knowledge, to increasing vehicle and traffic safety, for the benefit of manufacturers and users.

SUMMARY OF THE INVENTION

Bearing in mind the problems and deficiencies of the prior art, it is an object of the invention to improve an HF plug connector of the aforementioned type with regard to assembly and functional reliability.

This aim is achieved with an HF plug connector of the aforementioned type having the features and advantageous embodiments of the invention described in the claims.

The above and other objects, which will be apparent to those skilled in the art, are achieved in the present invention which is directed to an HF plug connector including an outer conductor part, an inner conductor part arranged within the outer conductor part and a mating-side end which is configured for plug-in connection to a complementary HF plug connector, wherein a housing made from an electrically insulating material is arranged at the mating-side end of the HF plug connector, at least partially surrounding the outer conductor part, wherein the housing has a through bore in which the outer conductor part engages, the outer conductor part comprising a first axial retaining element of the housing, configured such that the first axial retaining element expands a first pre-determined section of the housing on assembly thereof on the outer conductor part, and that the outer conductor part includes a second axial retaining element of the housing, configured such that the second axial retaining element compresses a second pre-determined section of the housing on assembly thereof on the outer conductor part.

The first axial retaining element, the second axial retaining element, or both, may be provided in a region of the outer conductor part which engages in the through bore of the housing.

The first axial retaining element may include at least one projection which is provided in the region of the outer conductor part which engages in the through bore of the housing, the projection being at least partially encompassing in the peripheral direction, wherein an outer diameter of the outer conductor part is larger in the region of the projection than an inner diameter of the through bore of the housing in the region of the first pre-determined section.

The second axial retaining element may be provided in the region of the outer conductor part which engages in the through bore of the housing and comprises at least one pair of claw-like projections which extend in the radial direction from the periphery of the outer conductor part, wherein the claw-like projections of one pair face one another in the peripheral direction. The second pre-determined section may include at least one web projecting radially inwardly from the inside of the housing and extending in the axial direction, such that a width of the web in the direction perpendicular to the axial direction is greater than a separation of the claw-like projections of one pair. The webs may be equally spaced apart from one another in the peripheral direction. The pairs of claw-like projections may be equally spaced apart from one another in the peripheral direction.

The housing includes mechanical dimensions in the interface region thereof which comply with the FAKRA standardization scheme for 50-Ω-HFSSt. The first axial retaining element, the second axial retaining element, or both, may be configured integrally with the outer conductor part. The outer conductor part may comprise a zinc diecast component.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
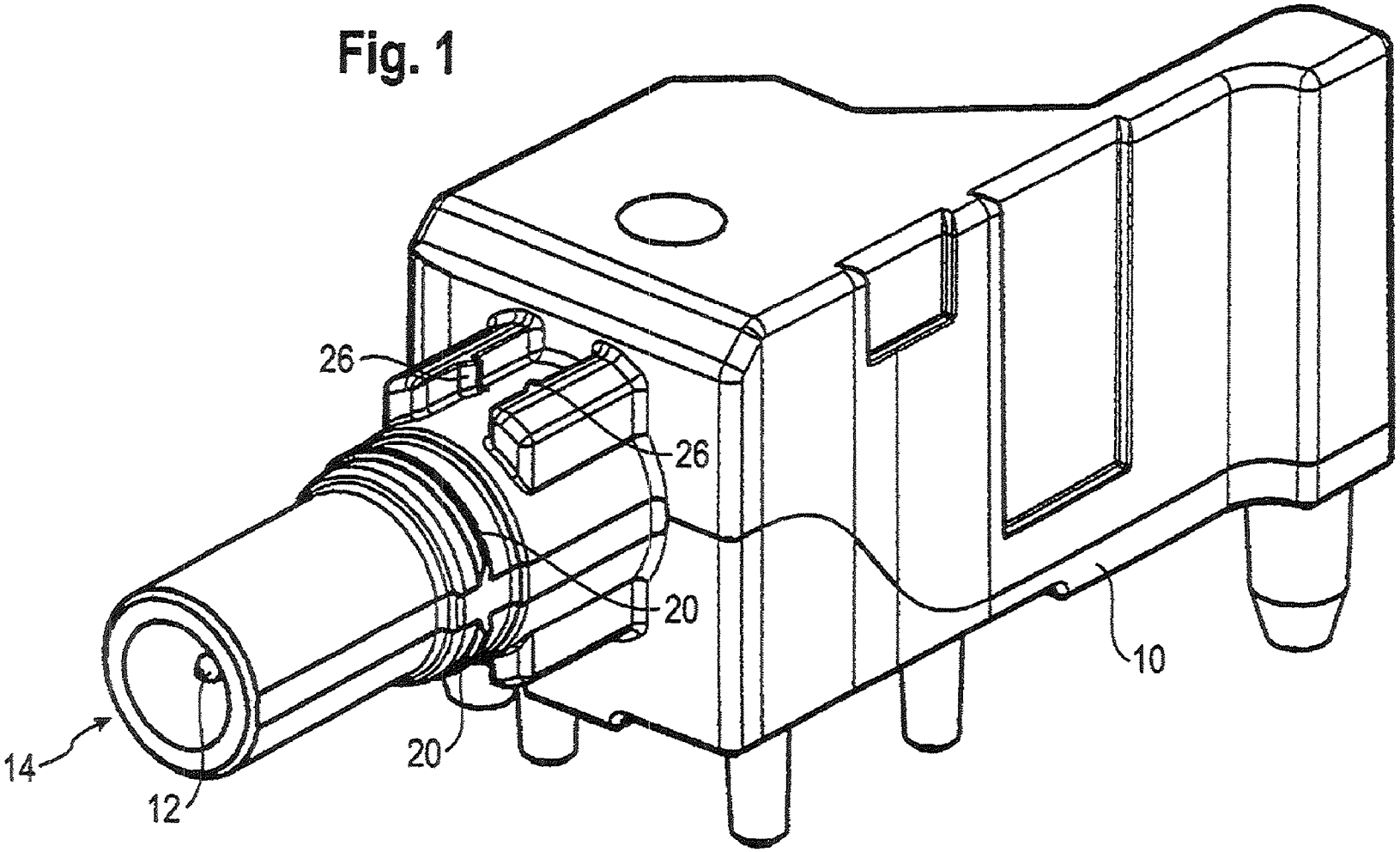
FIG. 1 shows a preferred embodiment of an HF plug connector according to the invention without the housing, in a perspective view.
Figure 2:
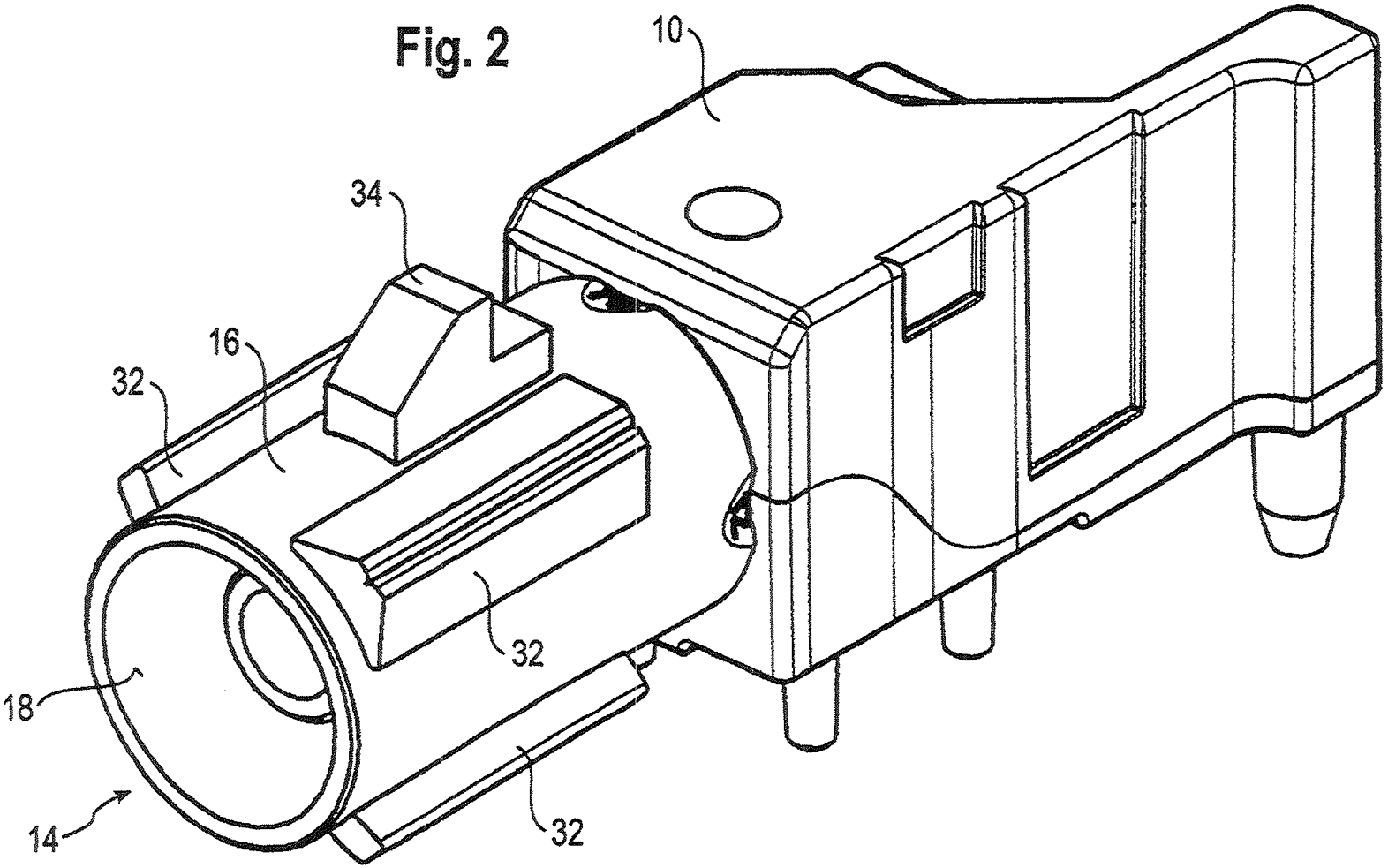
FIG. 2 shows the HF plug connector of FIG. 1 with the housing mounted, in a further perspective view.
Figure 3:
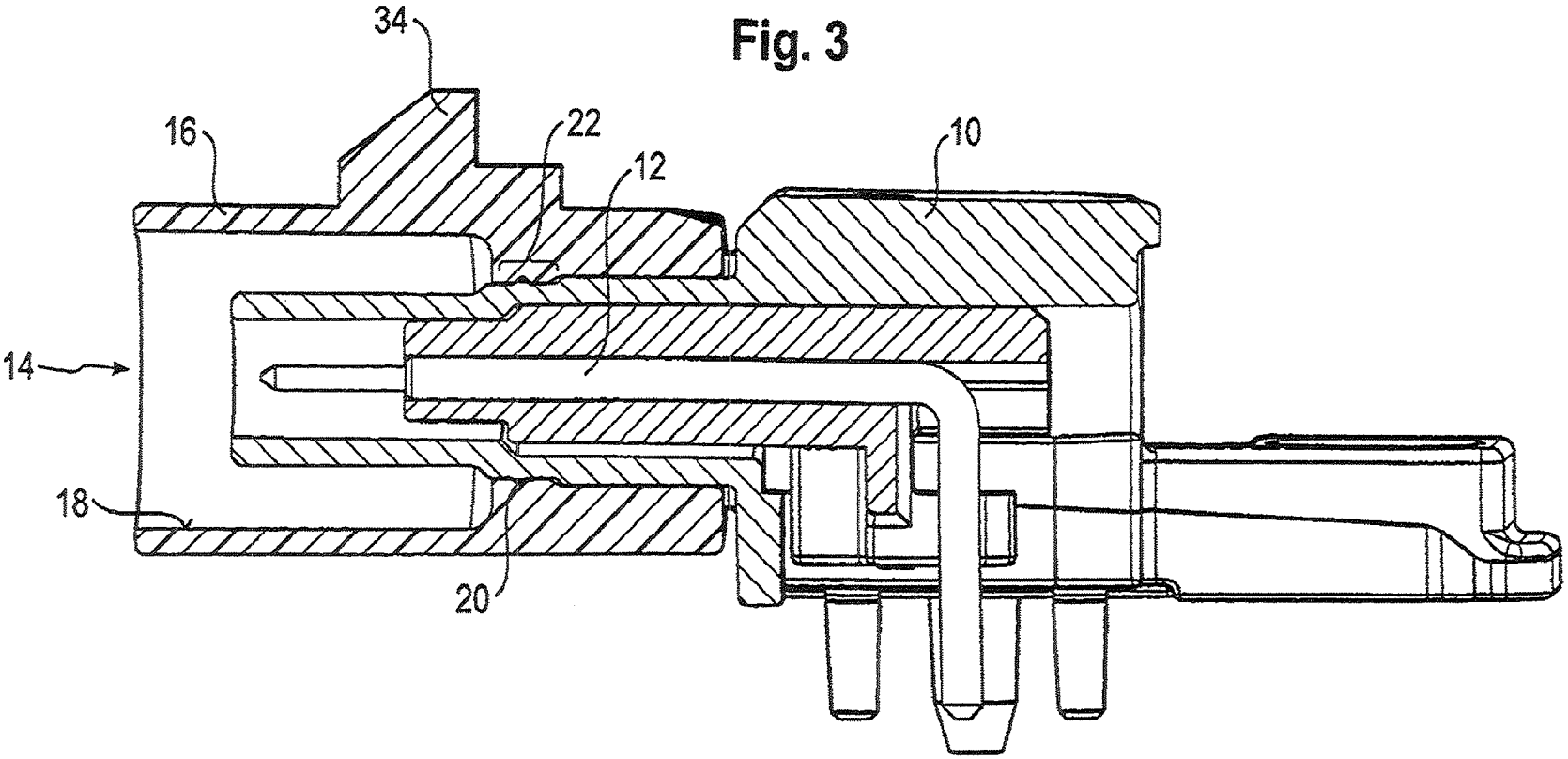
FIG. 3 shows the HF plug connector of FIG. 1 with the housing mounted, in a sectional view.

In describing the preferred embodiment of the present invention, reference will be made herein to FIGS. 1-6 of the drawings in which like numerals refer to like features of the invention.

In an HF plug connector of the aforementioned type, it is provided according to the invention that the outer conductor part comprises a first axial retaining element of the housing, configured such that the first axial retaining element expands a first pre-determined section of the housing on assembly thereof on the outer conductor part, and that the outer conductor part has a second axial retaining element of the housing, configured such that the second axial retaining element compresses a second pre-determined section of the housing on assembly thereof on the outer conductor part.

This has the advantage that the axial retaining element of the housing on the outer conductor part effectively prevents axial withdrawal of the housing from the outer conductor part regardless of the ambient temperature and therefore regardless of a temperature-dependent change in the dimensions of the housing.

Suitably, the first axial retaining element and/or the second axial retaining element is/are provided in a region of the outer conductor part which engages in the through bore of the housing.

In a preferred embodiment, the first axial retaining element has at least one projection which is provided in the region of the outer conductor part which engages in the through bore of the housing, the projection being at least partially encompassing in the peripheral direction, wherein an outer diameter of the outer conductor part is larger in the region of the projection than an inner diameter of the through bore of the housing in the region of the first pre-determined section.

In a preferred embodiment, the second axial retaining element is provided in the region of the outer conductor part which engages in the through bore of the housing and has at least one pair of claw-like projections which extend in the radial direction from the periphery of the outer conductor part, wherein the claw-like projections of one pair face one another in the peripheral direction.

In order to cooperate with the pairs of claw-like projections, the second pre-determined section has at least one web projecting radially inwardly from the inside of the housing and extending in the axial direction, wherein a width of the web in the direction perpendicular to the axial direction is greater than a separation of the claw-like projections of one pair.

In that two, three, four or more webs are provided and are spaced apart from one another in the peripheral direction, the housing can be mounted on the outer conductor part in different angular positions relative thereto. For this purpose, the webs are preferably equally spaced apart from one another in the peripheral direction.

Suitably, two or more pairs of claw-like projections are provided and, in particular, are equally spaced apart from one another in the peripheral direction.

In a preferred embodiment, the HF plug connector is configured as an HF coaxial plug connector, wherein the outer conductor part and the inner conductor part are arranged coaxially with one another.

Suitably, the housing is configured so as to have mechanical dimensions in the interface region thereof which comply with the FAKRA standardization scheme for 50-Ω-HFSSt.

In a preferred embodiment, the first axial retaining element and/or the second axial retaining element is/are configured integrally with the outer conductor part.

The outer conductor part is configured, for example, as a zinc diecast component.

The preferred embodiment of an HF plug connector according to the invention shown in FIGS. 1 to 6 is configured as an HF coaxial plug connector and comprises an outer conductor part 10, an inner conductor part 12 arranged within the outer conductor part 10 and a mating-side end 14, which is configured for plugged connection with a complementary HF plug connector (not shown). Arranged at the mating-side end 14 of the HF plug connector is a housing 16 which at least partially surrounds the outer conductor part 10 and is made from an electrically insulating material, for example, a plastics housing. Housing 16 has a through bore 18 in which the outer conductor part 10 engages.

The housing 16 is secured in the axial direction against withdrawal from the outer conductor part 10 or from a region 36 of the outer conductor part 10 which engages in the housing 16. For this purpose, according to the invention, two mutually independent axial retaining elements are provided. Both the axial retaining elements are provided, in the embodiment shown, at the outer periphery of the outer conductor part 10 in the region 36 which engages in the through bore 18 of the housing 16. A first axial retaining element of the housing 16 is configured such that the retaining element expands a first pre-determined section 22 of the housing 16 on assembly thereof on the outer conductor part 10. A second axial retaining element of the housing 16 is configured such that said retaining element compresses a second pre-determined section 24 of the housing 16 on assembly thereof on the outer conductor part 10.

As shown, in particular, by FIGS. 1, 3, 4 and 5, in relation to the illustrated preferred exemplary embodiment of the HF plug connector according to the invention, the first axial retaining element comprises two projections 20 which are provided on opposing sides in the region 36 of the outer conductor part 10 which engages in the through bore 18 of the housing 16, the projections being at least partially encompassing in the peripheral direction. Projections 20 are configured so that an outer diameter of the outer conductor part 10 is larger in the region of projections 20 than an inner diameter of the through bore 18 of the housing 16 in the region of the first pre-determined section 22. In this way, the housing 16 is expanded radially outwardly while the housing 16 is pushed axially onto the outer conductor part 10 as far as the desired position in the region of the first pre-determined section 22.

The resulting radially inwardly directed force due to the radial elastic expansion of the housing 16 holds the housing 16 firmly on the outer conductor part 10 and secures the housing 16 against axial withdrawal from the outer conductor part 10.

Figure 4:
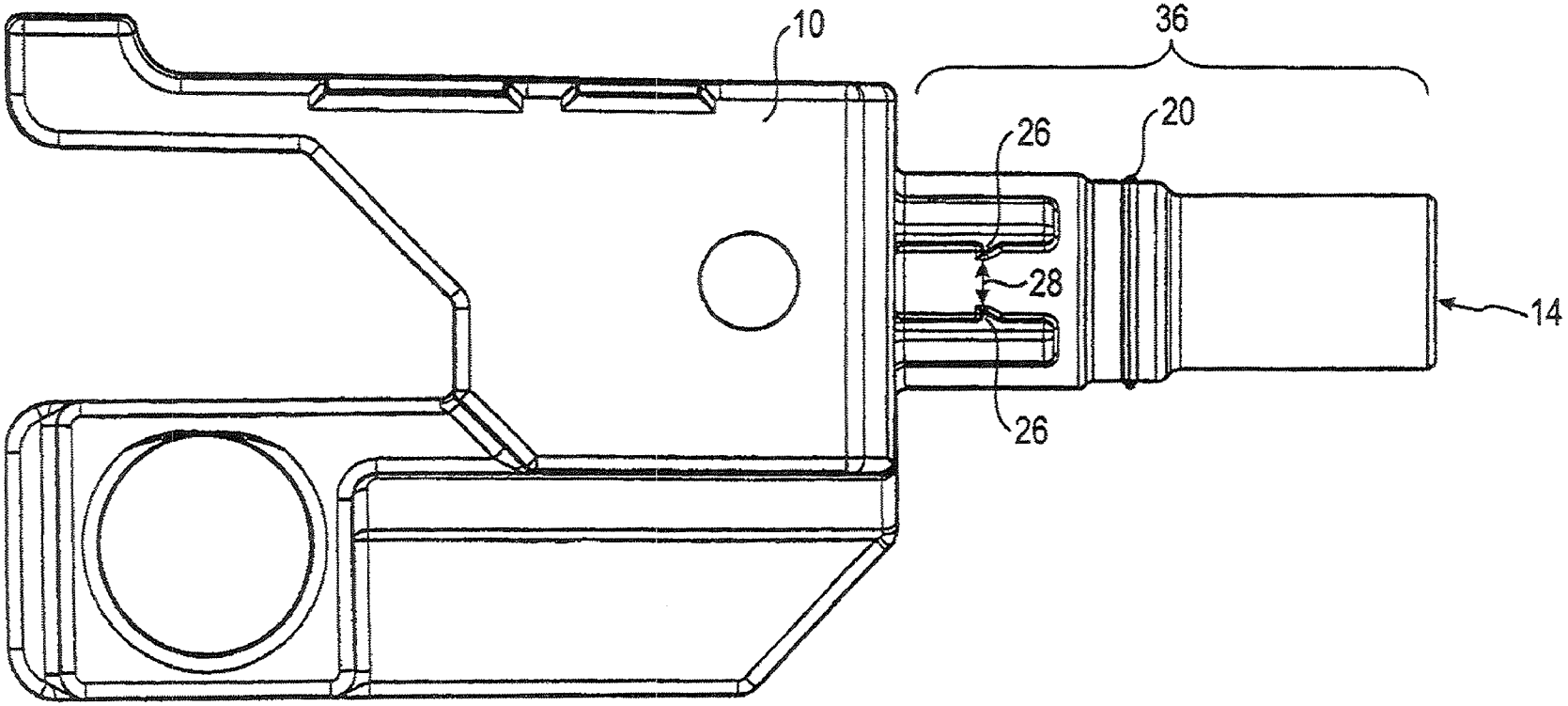
FIG. 4 shows the HF plug connector of FIG. 1 without the housing, in a view from above.
Figure 5:
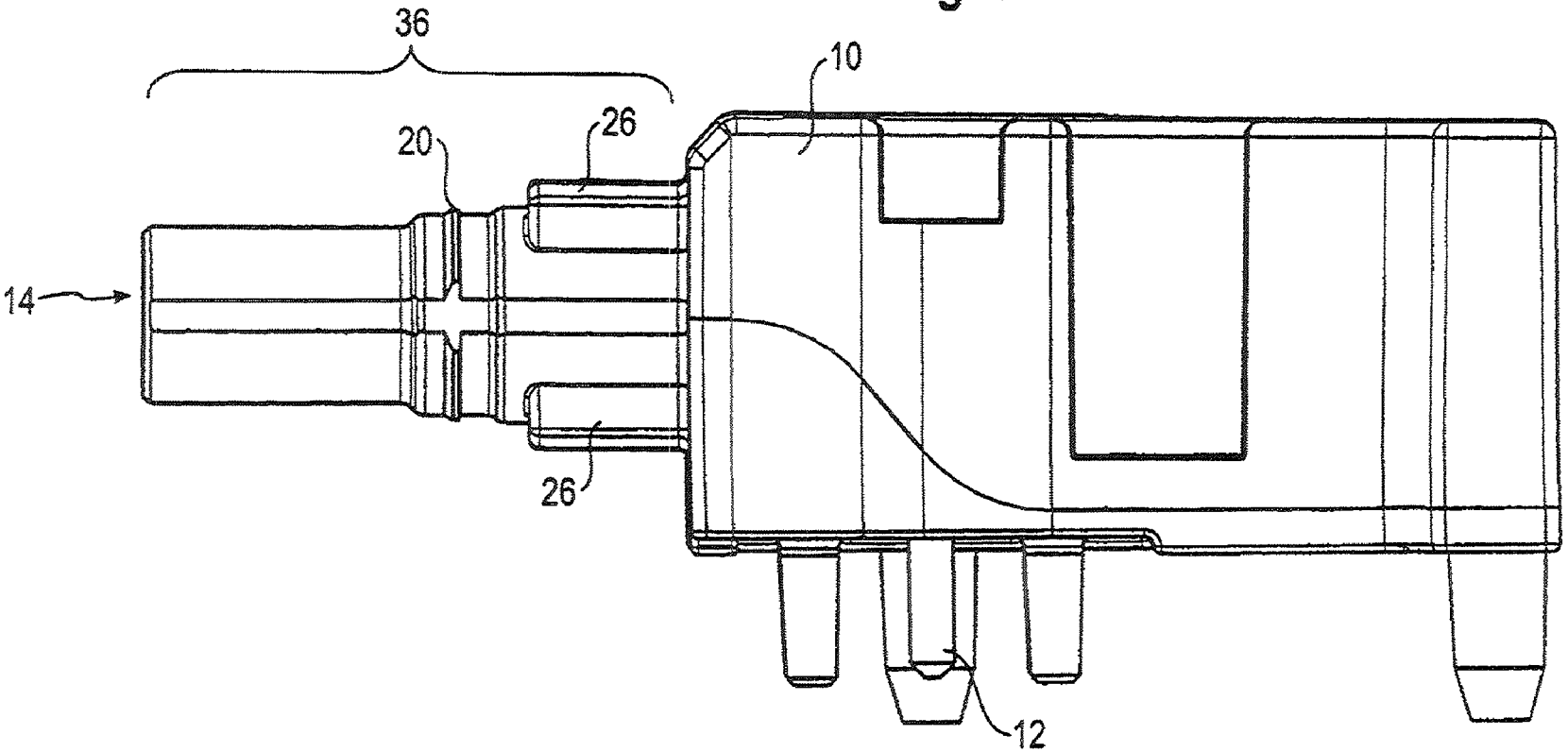
FIG. 5 shows the HF plug connector of FIG. 1 without the housing, in a side view.
Figure 6:
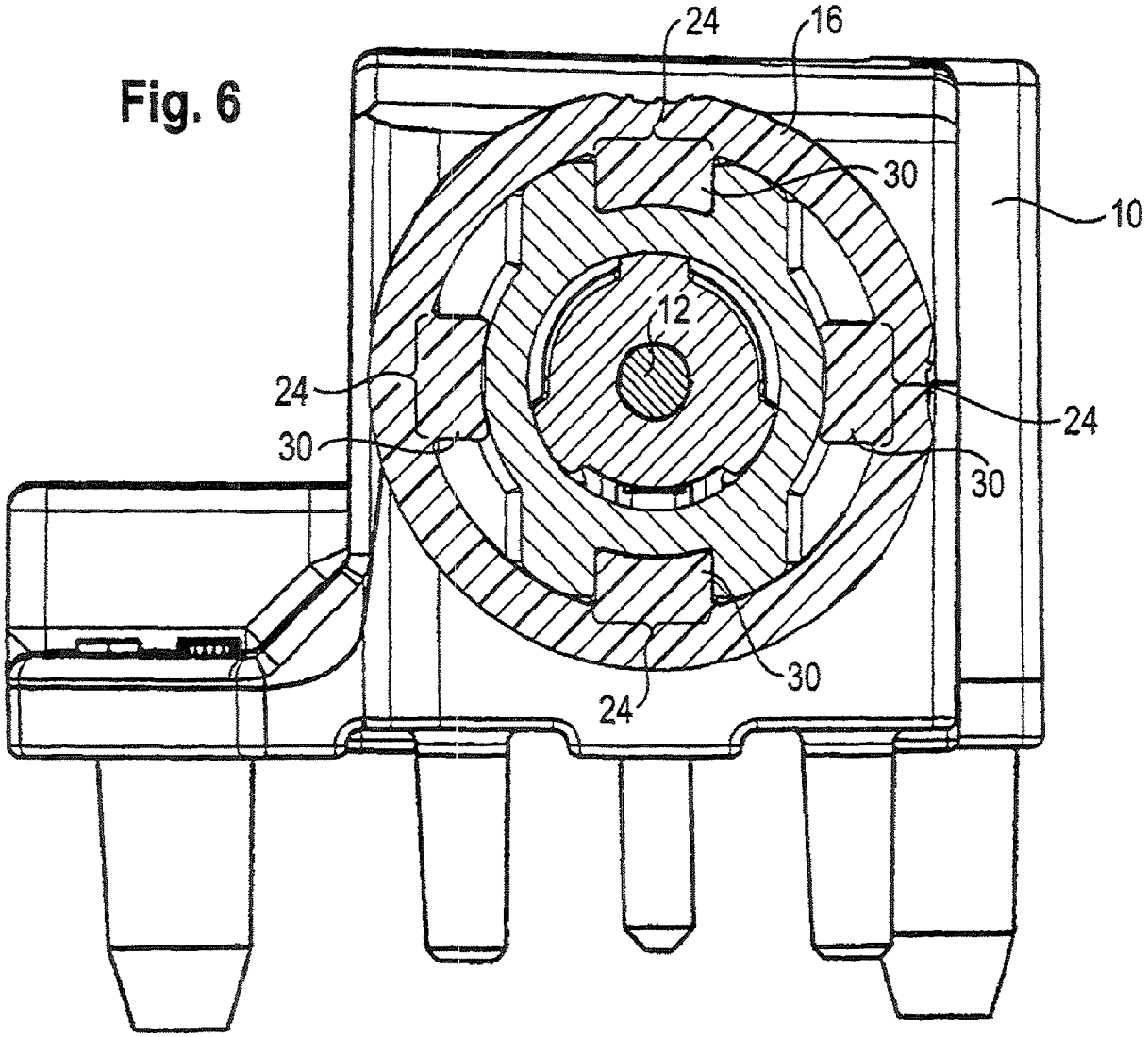
FIG. 6 shows the HF plug connector of FIG. 1, with the housing mounted, in a further sectional view.

As shown, in particular, by FIGS. 1, 4 and 6 for the exemplary, preferred embodiment of the HF plug connector according to the invention, the second axial retaining element comprises claw-like projections 26 which extend in the radial direction from the periphery of the outer conductor part. The two pairs of claw-like projections 26 are arranged at opposite sides of the outer conductor part 10 in the region 36 of the outer conductor part 10 which engages in the through bore 18 of the housing 16. The claw-like projections 26 of a pair face one another, seen in the peripheral direction, and are placed at a separation 28 from one another in the peripheral direction. Each claw-like projection 26 has a hook-like section which is directed away from the mating-side end 14. The second pre-determined region 24 of the housing 16 comprises four webs 30 each extending radially inwardly from the inside of the housing 16 in the axial direction. The webs 30 are equally spaced from one another in the peripheral direction such that when the housing is pushed axially onto the outer conductor part 10, two webs 30 engage between two claw-like projections 26 in every case, so that each pair of claw-like projections 26 cooperates with one of the webs 30. A width of the webs 30 in the direction perpendicular to the axial direction is greater than the separation 28 of the claw-like projections 26 of a pair. By this means, the claw-like projections 26 compress the webs 30. The resulting force between the claw-like projections 26 and the respective web 30 secures the housing 16 against withdrawal from the outer conductor part 10 in the axial direction, since the hooks of the claw-like projections 26 are directed, in the axial direction, away from the mating-side end 14. Due to the arrangement of pairs of claw-like projections 26 and the webs 30, the housing 16 can be pushed axially onto the outer conductor part 10 in different angular positions relative thereto. At the same time, the housing 16 is thus also secured against twisting in the peripheral direction relative to the outer conductor part 10.

A temperature-dependent increase in the dimensions of the housing 16 due to expansion at raised temperatures causes the holding force between the first pre-determined section 22 of the housing 16 and the projections 20 to diminish, since the internal diameter of the housing 16 increases in the first pre-determined section 22. However, the holding force between the claw-like projections 26 and the webs 30 simultaneously increases since, due to the temperature-dependent increase in the dimensions of the housing 16, the width of the webs 30 also increases. Sufficient axial securing of the housing 16 against axial withdrawal from the outer conductor part 10 is therefore ensured, even at high temperatures, by the second axial retaining element 26 in cooperation with the webs 30.

A temperature-dependent decrease in the dimensions of the housing 16 due to shrinkage at reduced temperatures causes the holding force between the claw-like projections 26 and the webs 30 to diminish, since the width of the webs 30 also decreases. However, the holding force between the first pre-determined section 22 of the housing 16 and the projections 20 simultaneously increases since, due to the temperature-dependent decrease in the dimensions of the housing 16, the internal diameter of the housing 16 is also decreased in the first pre-determined section 22. Sufficient axial securing of the housing 16 against axial withdrawal from the outer conductor part 10 is therefore ensured, even at low temperatures, by the first axial retaining element 20.

Overall, therefore, with temperature-related changes in the dimensions of the housing 16, due to the opposing effects of the axial retaining elements 20, 22 (on expansion) and 26, 30 (on shrinkage), there is a large temperature range over which the mechanical functional reliability of the HF plug connector according to the invention is ensured with regard to the axial hold of the housing 16 on the outer conductor part 10 and/or the region 36.

The housing 16 is configured as a FAKRA housing and has projections on the outer periphery thereof which serve as a mechanical encoding 32 for plugging together with other housings 16 and as a locking mechanism 34 for mechanical connection of two housings 16 when plugged together.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An HF plug connector including an outer conductor part, an inner conductor part arranged within the outer conductor part and a mating-side end which is configured for plug-in connection to a complementary HF plug connector, wherein a housing made from an electrically insulating material is arranged at the mating-side end of the HF plug connector, at least partially surrounding the outer conductor part, wherein the housing has a through bore in which the outer conductor part engages, the outer conductor part comprising a first axial retaining element of the housing, configured such that said first axial retaining element expands a first pre-determined section of the housing on assembly thereof on the outer conductor part, and that the outer conductor part includes a second axial retaining element of the housing, configured such that said second axial retaining element compresses a second pre-determined section of the housing on assembly thereof on the outer conductor part.

2. The HF plug connector of claim 1, wherein the first axial retaining element includes at least one projection which is provided in the region of the outer conductor part which engages in the through bore of the housing, said projection being at least partially encompassing in the peripheral direction, wherein an outer diameter of the outer conductor part is larger in the region of said projection than an inner diameter of the through bore of the housing in the region of the first pre-determined section.

3. The HF plug connector of claim 1, wherein the HF plug connector is configured as an HF coaxial plug connector, having the outer conductor part and the inner conductor part arranged coaxially with one another.

4. The HF plug connector of claim 1, wherein the housing includes mechanical dimensions in the interface region thereof which comply with the FAKRA standardization scheme for 50-Ω-HFSSt.

5. The HF plug connector of claim 1, wherein the first axial retaining element, the second axial retaining element, or both, are configured integrally with the outer conductor part.

6. The HF plug of claim 1, wherein the outer conductor part comprises a zinc diecast component.

7. The HF plug connector of claim 1, wherein the first axial retaining element, the second axial retaining element, or both, are provided in a region of the outer conductor part which engages in the through bore of the housing.

8. The HF plug connector of claim 7, wherein the first axial retaining element includes at least one projection which is provided in the region of the outer conductor part which engages in the through bore of the housing, said projection being at least partially encompassing in the peripheral direction, wherein an outer diameter of the outer conductor part is larger in the region of said projection than an inner diameter of the through bore of the housing in the region of the first pre-determined section.

9. The HF plug connector of claim 8, including the second axial retaining element provided in the region of the outer conductor part which engages in the through bore of the housing and comprises at least one pair of claw-like projections which extend in the radial direction from the periphery of the outer conductor part, wherein the claw-like projections of one pair face one another in the peripheral direction.

10. The HF plug connector of claim 9, wherein the first axial retaining element, the second axial retaining element, or both, are configured integrally with the outer conductor part.

11. The HF plug connector of claim 1, including the second axial retaining element provided in the region of the outer conductor part which engages in the through bore of the housing and comprises at least one pair of claw-like projections which extend in the radial direction from the periphery of the outer conductor part, wherein the claw-like projections of one pair face one another in the peripheral direction.

12. The HF plug connector of claim 11, wherein the first axial retaining element, the second axial retaining element, or both, are configured integrally with the outer conductor part.

13. The HF plug connector of claim 11, including two or more pairs of claw-like projections spaced apart from one another in the peripheral direction.

14. The HF plug connector of claim 13, wherein the pairs of claw-like projections are equally spaced apart from one another in the peripheral direction.

15. The HF plug connector of claim 11, wherein the second pre-determined section includes at least one web projecting radially inwardly form the inside of the housing and extending the axial direction, such that a width of the web in the direction perpendicular to the axial direction is greater than a separation of the claw-like projections of one pair.

16. The HF plug connector of claim 15, including two or more pairs of claw-like projections spaced apart from one another in the peripheral direction.

17. The HF plug connector of claim 16, wherein the pairs of claw-like projections are equally spaced apart from one another in the peripheral direction.

18. The HF plug connector of claim 15, including two, three, four, or more webs spaced apart from one another in the peripheral direction.

19. The HF plug connector of claim 18, including two or more pairs of claw-like projections spaced apart from one another in the peripheral direction.

20. The HF plug connector of claim 18, wherein the webs are equally spaced apart from one another in the peripheral direction.

21. The HF plug connector of claim 20, wherein the HF plug connector is configured as an HF coaxial plug connector, having the outer conductor part and the inner conductor part arranged coaxially with one another.

22. The HF plug connector of claim 20, wherein the housing includes mechanical dimensions in the interface region thereof which comply with the FAKRA standardization scheme for 50-Ω-HFSSt.

23. The HF plug of claim 20, wherein the outer conductor part comprises a zinc diecast component.

* * * * *